US009004316B2

(12) United States Patent
Greer, Jr. et al.

(10) Patent No.: US 9,004,316 B2
(45) **Date of Patent: *Apr. 14, 2015**

(54) AEROSOL SPRAY TEXTURE APPARATUS FOR A PARTICULATE CONTAINING MATERIAL

(71) Applicant: Homax Products, Inc., Bellingham, WA (US)

(72) Inventors: Lester R. Greer, Jr., Seattle, WA (US); Floyd R. French, Bellingham, WA (US)

(73) Assignee: Homax Products, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/059,277

(22) Filed: Oct. 21, 2013

(65) Prior Publication Data

US 2014/0050853 A1 Feb. 20, 2014

Related U.S. Application Data

(63) Continuation of application No. 13/597,181, filed on Aug. 28, 2012, now Pat. No. 8,561,840, which is a continuation of application No. 12/725,417, filed on Mar. 16, 2010, now Pat. No. 8,251,255, which is a (Continued)

(51) Int. Cl.
*G01F 11/00* (2006.01)
*E04B 1/84* (2006.01)
(Continued)

(52) U.S. Cl.
CPC . *E04B 1/84* (2013.01); *B65D 83/30* (2013.01); *B65D 83/48* (2013.01)

(58) Field of Classification Search
CPC ..... B65D 83/14; B65D 83/38; B65D 83/46; B65D 83/48; B65D 83/752; B05C 5/0225; C08J 9/0061
USPC ..... 222/1, 394, 402.1, 402.11, 402.18, 222/402.21–402.25; 239/337, 340, 592, 239/597; 521/50, 78
See application file for complete search history.

(56) References Cited

U.S. PATENT DOCUMENTS 208,330 A 9/1878 Palmer
351,968 A 11/1886 Derrick
(Continued)

FOREIGN PATENT DOCUMENTS

CA 770467 10/1967
CA 976125 10/1975
(Continued)

OTHER PUBLICATIONS

ASTM, "Standard Test Method for Conducting Cyclic Potentiodynamic Polarization Measurements for Localized Corrosion Susceptibility of Iron-Nickel, or Cobalt-Based Alloys," 1993, 5 pages.

(Continued)

*Primary Examiner* — Frederick C Nicolas
(74) *Attorney, Agent, or Firm* — Michael R. Schacht

(57) ABSTRACT

A composition for forming an acoustic texture material on a surface has a propellant material and acoustic texture material. The propellant material includes di-methyl ether. The acoustic texture material includes a coating portion including a base, a filler, and a binder and chips of chip material having a physical structure. When the propellant material and the acoustic texture material are mixed together, the propellant material does not substantially alter the physical structure of the chip material.

7 Claims, 2 Drawing Sheets

Related U.S. Application Data continuation of application No. 11/173,492, filed on Jun. 30, 2005, now Pat. No. 7,677,420.

(60) Provisional application No. 60/585,233, filed on Jul. 2, 2004.

(51) Int. Cl.
*B65D 83/30* (2006.01)
*B65D 83/48* (2006.01)

(56) References Cited

U.S. PATENT DOCUMENTS

| | | | |
|---|---|---|---|
| D25,916 | S | 8/1896 | Woods |
| 568,876 | A | 10/1896 | Regan |
| 579,418 | A | 3/1897 | Bookwalter |
| 582,397 | A | 5/1897 | Shone |
| 658,586 | A | 9/1900 | Reiling |
| 930,095 | A | 8/1909 | Seagrave |
| 931,757 | A | 8/1909 | Harmer |
| 941,671 | A | 11/1909 | Campbell |
| 1,093,907 | A | 4/1914 | Birnbaum |
| 1,154,974 | A | 9/1915 | Custer |
| 1,486,156 | A | 3/1924 | Needham |
| 2,127,188 | A | 8/1938 | Schellin et al. |
| 2,149,930 | A | 3/1939 | Plastaras |
| D134,562 | S | 7/1942 | Murphy |
| 2,307,014 | A | 1/1943 | Becker et al. |
| 2,320,964 | A | 6/1943 | Yates |
| 2,353,318 | A | 7/1944 | Scheller |
| 2,388,093 | A | 10/1945 | Smith |
| 2,530,808 | A | 11/1950 | Cerasi |
| 2,565,954 | A | 8/1951 | Dey |
| 2,612,293 | A | 9/1952 | Michel |
| 2,686,652 | A | 8/1954 | Carlson et al. |
| 2,723,200 | A | 11/1955 | Pyenson |
| 2,763,406 | A | 9/1956 | Countryman |
| 2,764,454 | A | 9/1956 | Edelstein |
| 2,785,926 | A | 3/1957 | Lataste |
| 2,790,680 | A | 4/1957 | Rosholt |
| 2,831,618 | A | 4/1958 | Soffer et al. |
| 2,839,225 | A | 6/1958 | Soffer et al. |
| 2,908,446 | A | 10/1959 | Strouse |
| 2,932,434 | A | 4/1960 | Abplanalp |
| 2,965,270 | A | 12/1960 | Soffer et al. |
| 2,968,441 | A | 1/1961 | Holcomb |
| 2,976,897 | A | 3/1961 | Beckworth |
| 2,997,243 | A | 8/1961 | Kolb |
| 3,083,872 | A | 4/1963 | Meshberg |
| 3,107,059 | A | 10/1963 | Frechette |
| 3,167,525 | A | 1/1965 | Thomas |
| 3,191,809 | A | 6/1965 | Schultz et al. |
| 3,196,819 | A | 7/1965 | Lechner et al. |
| 3,198,394 | A | 8/1965 | Lefer |
| 3,216,628 | A | 11/1965 | Fergusson |
| 3,246,850 | A | 4/1966 | Bourke |
| 3,258,208 | A | 6/1966 | Greenebaum, II |
| 3,284,007 | A | 11/1966 | Clapp |
| 3,314,571 | A | 4/1967 | Greenebaum, II |
| 3,317,140 | A | 5/1967 | Smith |
| 3,342,382 | A | 9/1967 | Huling |
| 3,346,195 | A | 10/1967 | Groth |
| 3,373,908 | A | 3/1968 | Crowell |
| 3,377,028 | A | 4/1968 | Bruggeman |
| 3,390,121 | A | 6/1968 | Burford |
| 3,405,845 | A | 10/1968 | Cook et al. |
| 3,414,171 | A | 12/1968 | Grisham et al. |
| 3,415,425 | A | 12/1968 | Knight et al. |
| 3,425,600 | A | 2/1969 | Abplanalp |
| 3,428,224 | A | 2/1969 | Eberhardt et al. |
| 3,433,391 | A | 3/1969 | Krizka et al. |
| 3,450,314 | A | 6/1969 | Gross |
| 3,467,283 | A | 9/1969 | Kinnavy |
| 3,472,457 | A | 10/1969 | McAvoy |
| 3,482,738 | A | 12/1969 | Bartels |
| 3,513,886 | A | 5/1970 | Easter et al. |
| 3,514,042 | A | 5/1970 | Freed |
| 3,544,258 | A | 12/1970 | Presant et al. |
| 3,548,564 | A | 12/1970 | Bruce et al. |
| 3,550,861 | A | 12/1970 | Teson |
| 3,575,319 | A | 4/1971 | Safianoff |
| 3,592,359 | A | 7/1971 | Marraffino |
| 3,596,835 | A | 8/1971 | Smith |
| 3,608,822 | A | 9/1971 | Berthoud |
| 3,613,954 | A | 10/1971 | Bayne |
| 3,648,932 | A | 3/1972 | Ewald et al. |
| 3,653,558 | A | 4/1972 | Shay |
| 3,698,645 | A | 10/1972 | Coffey |
| 3,700,136 | A | 10/1972 | Ruekberg |
| 3,703,994 | A | 11/1972 | Nigro |
| 3,704,811 | A | 12/1972 | Harden, Jr. |
| 3,704,831 | A | 12/1972 | Clark |
| 3,705,669 | A | 12/1972 | Cox et al. |
| 3,711,030 | A | 1/1973 | Jones |
| 3,764,067 | A | 10/1973 | Coffey et al. |
| 3,770,166 | A | 11/1973 | Marand |
| 3,773,706 | A | 11/1973 | Dunn, Jr. |
| 3,776,470 | A | 12/1973 | Tsuchiya |
| 3,776,702 | A | 12/1973 | Chant |
| 3,777,981 | A | 12/1973 | Probst et al. |
| 3,788,521 | A | 1/1974 | Laauwe |
| 3,795,366 | A | 3/1974 | McGhie et al. |
| 3,799,398 | A | 3/1974 | Morane et al. |
| 3,806,005 | A | 4/1974 | Prussin et al. |
| 3,811,369 | A | 5/1974 | Ruegg |
| 3,813,011 | A | 5/1974 | Harrison et al. |
| 3,814,326 | A | 6/1974 | Bartlett |
| 3,819,119 | A | 6/1974 | Coffey et al. |
| 3,828,977 | A | 8/1974 | Borchert |
| 3,848,778 | A | 11/1974 | Meshberg |
| 3,862,705 | A | 1/1975 | Beres et al. |
| 3,871,553 | A | 3/1975 | Steinberg |
| 3,891,128 | A | 6/1975 | Smrt |
| 3,912,132 | A | 10/1975 | Stevens |
| 3,913,803 | A | 10/1975 | Laauwe |
| 3,913,804 | A | 10/1975 | Laauwe |
| 3,913,842 | A | 10/1975 | Singer |
| 3,932,973 | A | 1/1976 | Moore |
| 3,936,002 | A | 2/1976 | Geberth, Jr. |
| 3,938,708 | A | 2/1976 | Burger |
| 3,975,554 | A | 8/1976 | Kummins et al. |
| 3,982,698 | A | 9/1976 | Anderson |
| 3,989,165 | A | 11/1976 | Shaw et al. |
| 3,991,916 | A | 11/1976 | Del Bon |
| 3,992,003 | A | 11/1976 | Visceglia et al. |
| 4,010,134 | A | 3/1977 | Braunisch et al. |
| 4,032,064 | A | 6/1977 | Giggard |
| 4,036,673 | A | 7/1977 | Murphy et al. |
| 4,045,860 | A | 9/1977 | Winckler |
| 4,089,443 | A | 5/1978 | Zrinyi |
| 4,096,974 | A | 6/1978 | Haber et al. |
| 4,117,951 | A | 10/1978 | Winckler |
| 4,129,448 | A | 12/1978 | Greenfield et al. |
| 4,147,284 | A | 4/1979 | Mizzi |
| 4,148,416 | A | 4/1979 | Gunn-Smith |
| 4,154,378 | A | 5/1979 | Paoletti et al. |
| 4,164,492 | A | 8/1979 | Cooper |
| RE30,093 | E | 9/1979 | Burger |
| 4,171,757 | A | 10/1979 | Diamond |
| 4,173,558 | A | 11/1979 | Beck |
| 4,185,758 | A | 1/1980 | Giggard |
| 4,187,959 | A | 2/1980 | Pelton |
| 4,187,985 | A | 2/1980 | Goth |
| 4,198,365 | A | 4/1980 | Pelton |
| 4,202,470 | A | 5/1980 | Fujii |
| 4,238,264 | A | 12/1980 | Pelton |
| 4,240,940 | A | 12/1980 | Vasishth et al. |
| 4,258,141 | A | 3/1981 | Jarre et al. |
| 4,275,172 | A | 6/1981 | Barth et al. |
| 4,293,353 | A | 10/1981 | Pelton et al. |
| 4,308,973 | A | 1/1982 | Irland |
| 4,310,108 | A | 1/1982 | Motoyama et al. |
| 4,322,020 | A | 3/1982 | Stone |
| 4,346,743 | A | 8/1982 | Miller |

(56) References Cited

U.S. PATENT DOCUMENTS

| | | | |
|---|---|---|---|
| 4,354,638 | A | 10/1982 | Weinstein |
| 4,358,388 | A | 11/1982 | Daniel et al. |
| 4,370,930 | A | 2/1983 | Strasser et al. |
| 4,372,475 | A | 2/1983 | Goforth et al. |
| 4,401,271 | A | 8/1983 | Hansen |
| 4,401,272 | A | 8/1983 | Merton et al. |
| 4,411,387 | A | 10/1983 | Stern et al. |
| 4,417,674 | A | 11/1983 | Giuffredi |
| 4,438,221 | A | 3/1984 | Fracalossi et al. |
| 4,442,959 | A | 4/1984 | Del Bon et al. |
| 4,460,719 | A | 7/1984 | Danville |
| 4,482,662 | A | 11/1984 | Rapaport et al. |
| 4,496,081 | A | 1/1985 | Farrey |
| 4,546,905 | A | 10/1985 | Nandagiri et al. |
| 4,595,127 | A | 6/1986 | Stoody |
| 4,609,608 | A | 9/1986 | Solc |
| 4,641,765 | A | 2/1987 | Diamond |
| 4,683,246 | A | 7/1987 | Davis et al. |
| 4,702,400 | A | 10/1987 | Corbett |
| 4,728,007 | A | 3/1988 | Samuelson et al. |
| 4,744,495 | A | 5/1988 | Warby |
| 4,761,312 | A | 8/1988 | Koshi et al. |
| 4,792,062 | A | 12/1988 | Goncalves |
| 4,793,162 | A | 12/1988 | Emmons |
| 4,804,144 | A | 2/1989 | Denman |
| 4,815,414 | A | 3/1989 | Duffy et al. |
| 4,819,838 | A | 4/1989 | Hart, Jr. |
| 4,830,224 | A | 5/1989 | Brison |
| 4,839,393 | A | 6/1989 | Buchanan et al. |
| 4,854,482 | A | 8/1989 | Bergner |
| 4,870,805 | A | 10/1989 | Morane |
| 4,878,599 | A | 11/1989 | Greenway |
| 4,887,651 | A | 12/1989 | Santiago |
| 4,893,730 | A | 1/1990 | Bolduc |
| 4,896,832 | A | 1/1990 | Howlett |
| D307,649 | S | 5/1990 | Henry |
| 4,940,171 | A | 7/1990 | Gilroy |
| 4,949,871 | A | 8/1990 | Flanner |
| 4,953,759 | A | 9/1990 | Schmidt |
| 4,954,544 | A | 9/1990 | Chandaria |
| 4,955,545 | A | 9/1990 | Stern et al. |
| 4,961,537 | A | 10/1990 | Stern |
| 4,969,577 | A | 11/1990 | Werding |
| 4,969,579 | A | 11/1990 | Behar |
| 4,988,017 | A | 1/1991 | Schrader et al. |
| 4,991,750 | A | 2/1991 | Moral |
| 5,007,556 | A | 4/1991 | Lover |
| 5,009,390 | A | 4/1991 | McAuliffe, Jr. et al. |
| 5,037,011 | A | 8/1991 | Woods |
| 5,038,964 | A | 8/1991 | Bouix |
| 5,052,585 | A | 10/1991 | Bolduc |
| 5,059,187 | A | 10/1991 | Sperry et al. |
| 5,065,900 | A | 11/1991 | Scheindel |
| 5,069,390 | A | 12/1991 | Stern et al. |
| 5,083,685 | A | 1/1992 | Amemiya et al. |
| 5,100,055 | A | 3/1992 | Rokitenetz et al. |
| 5,115,944 | A | 5/1992 | Nikolich |
| 5,126,086 | A | 6/1992 | Stoffel |
| 5,169,037 | A | 12/1992 | Davies et al. |
| 5,182,316 | A | 1/1993 | DeVoe et al. |
| 5,188,263 | A | 2/1993 | Woods |
| 5,188,295 | A | 2/1993 | Stern et al. |
| 5,211,317 | A | 5/1993 | Diamond et al. |
| 5,219,609 | A | 6/1993 | Owens |
| 5,250,599 | A | 10/1993 | Swartz |
| 5,277,336 | A | 1/1994 | Youel |
| 5,297,704 | A | 3/1994 | Stollmeyer |
| 5,307,964 | A | 5/1994 | Toth |
| 5,310,095 | A | 5/1994 | Stern et al. |
| 5,312,888 | A | 5/1994 | Nafziger et al. |
| 5,314,097 | A | 5/1994 | Smrt et al. |
| 5,323,963 | A | 6/1994 | Ballu |
| 5,341,970 | A | 8/1994 | Woods |
| 5,342,597 | A | 8/1994 | Tunison, III |
| 5,368,207 | A | 11/1994 | Cruysberghs |
| 5,374,434 | A | 12/1994 | Clapp et al. |
| 5,405,051 | A | 4/1995 | Miskell |
| 5,409,148 | A | 4/1995 | Stern et al. |
| 5,417,357 | A | 5/1995 | Yquel |
| D358,989 | S | 6/1995 | Woods |
| 5,421,519 | A | 6/1995 | Woods |
| 5,425,824 | A | 6/1995 | Marwick |
| 5,450,983 | A | 9/1995 | Stern et al. |
| 5,467,902 | A | 11/1995 | Yquel |
| 5,476,879 | A | 12/1995 | Woods et al. |
| 5,489,048 | A | 2/1996 | Stern et al. |
| 5,498,282 | A | 3/1996 | Miller et al. |
| 5,501,375 | A | 3/1996 | Nilson |
| 5,505,344 | A | 4/1996 | Woods |
| 5,523,798 | A | 6/1996 | Hagino et al. |
| 5,524,798 | A | 6/1996 | Stern et al. |
| 5,544,783 | A | 8/1996 | Conigliaro |
| 5,548,010 | A | 8/1996 | Franer |
| 5,549,228 | A | 8/1996 | Brown |
| 5,558,247 | A | 9/1996 | Caso |
| 5,562,235 | A | 10/1996 | Cruysberghs |
| 5,570,813 | A | 11/1996 | Clark, II |
| 5,573,137 | A | 11/1996 | Pauls |
| 5,583,178 | A | 12/1996 | Oxman et al. |
| 5,597,095 | A | 1/1997 | Ferrara, Jr. |
| 5,605,259 | A | 2/1997 | Clawson |
| 5,615,804 | A | 4/1997 | Brown |
| 5,639,026 | A | 6/1997 | Woods |
| 5,641,095 | A | 6/1997 | de Laforcade |
| 5,645,198 | A | 7/1997 | Stern et al. |
| 5,655,691 | A | 8/1997 | Stern et al. |
| 5,695,788 | A | 12/1997 | Woods |
| 5,715,975 | A | 2/1998 | Stern et al. |
| 5,727,736 | A | 3/1998 | Tryon |
| 5,752,631 | A | 5/1998 | Yabuno et al. |
| 5,775,432 | A | 7/1998 | Burns et al. |
| 5,792,465 | A | 8/1998 | Hagarty |
| 5,799,879 | A | 9/1998 | Ottle et al. |
| 5,865,351 | A | 2/1999 | De Laforcade |
| 5,868,286 | A | 2/1999 | Mascitelli |
| 5,887,756 | A | 3/1999 | Brown |
| 5,894,964 | A | 4/1999 | Barnes et al. |
| 5,915,598 | A | 6/1999 | Yazawa et al. |
| 5,921,446 | A | 7/1999 | Stern |
| 5,934,518 | A | 8/1999 | Stern et al. |
| 5,941,462 | A | 8/1999 | Sandor |
| 5,957,333 | A | 9/1999 | Losenno et al. |
| 5,975,356 | A | 11/1999 | Yquel et al. |
| 5,988,575 | A | 11/1999 | Lesko |
| 6,000,583 | A | 12/1999 | Stern et al. |
| 6,027,042 | A | 2/2000 | Smith |
| 6,032,830 | A | 3/2000 | Brown |
| 6,039,306 | A | 3/2000 | Pericard et al. |
| 6,062,494 | A | 5/2000 | Mills |
| 6,070,770 | A | 6/2000 | Tada et al. |
| 6,092,698 | A | 7/2000 | Bayer |
| 6,095,435 | A | 8/2000 | Greer, Jr. et al. |
| 6,112,945 | A | 9/2000 | Woods |
| 6,113,070 | A | 9/2000 | Holzboog |
| 6,116,473 | A | 9/2000 | Stern et al. |
| 6,129,247 | A | 10/2000 | Thomas et al. |
| 6,131,777 | A | 10/2000 | Warby |
| 6,139,821 | A | 10/2000 | Fuerst et al. |
| 6,152,335 | A | 11/2000 | Stern et al. |
| 6,161,735 | A | 12/2000 | Uchiyama et al. |
| 6,168,093 | B1 | 1/2001 | Greer, Jr. et al. |
| 6,170,717 | B1 | 1/2001 | Di Giovanni et al. |
| D438,111 | S | 2/2001 | Woods |
| D438,786 | S | 3/2001 | Ghali |
| 6,225,393 | B1 | 5/2001 | Woods |
| 6,254,015 | B1 | 7/2001 | Abplanalp |
| 6,257,503 | B1 | 7/2001 | Baudin |
| 6,261,631 | B1 | 7/2001 | Lomasney et al. |
| 6,265,459 | B1 | 7/2001 | Mahoney et al. |
| 6,276,570 | B1 | 8/2001 | Stern et al. |
| 6,283,171 | B1 | 9/2001 | Blake |
| 6,284,077 | B1 | 9/2001 | Lucas et al. |
| 6,290,104 | B1 | 9/2001 | Bougamont et al. |
| 6,291,536 | B1 | 9/2001 | Taylor |

(56) References Cited

U.S. PATENT DOCUMENTS

| | | | |
|---|---|---|---|
| 6,296,155 | B1 | 10/2001 | Smith |
| 6,296,156 | B1 | 10/2001 | Lasserre et al. |
| 6,299,679 | B1 | 10/2001 | Montoya |
| 6,299,686 | B1 | 10/2001 | Mills |
| 6,315,152 | B1 | 11/2001 | Kalisz |
| 6,325,256 | B1 | 12/2001 | Liljeqvist et al. |
| 6,328,185 | B1 | 12/2001 | Stern et al. |
| 6,328,197 | B1 | 12/2001 | Gapihan |
| 6,333,365 | B1 | 12/2001 | Lucas et al. |
| 6,352,184 | B1 | 3/2002 | Stern et al. |
| 6,362,302 | B1 | 3/2002 | Boddie |
| 6,375,036 | B1 | 4/2002 | Woods |
| 6,382,474 | B1 | 5/2002 | Woods |
| 6,386,402 | B1 | 5/2002 | Woods |
| 6,394,321 | B1 | 5/2002 | Bayer |
| 6,394,364 | B1 | 5/2002 | Abplanalp |
| 6,395,794 | B2 | 5/2002 | Lucas et al. |
| 6,398,082 | B2 | 6/2002 | Clark et al. |
| 6,399,687 | B2 | 6/2002 | Woods |
| 6,414,044 | B2 | 7/2002 | Taylor |
| 6,415,964 | B2 | 7/2002 | Woods |
| 6,439,430 | B1 | 8/2002 | Gilroy, Sr. et al. |
| 6,446,842 | B2 | 9/2002 | Stern et al. |
| D464,395 | S | 10/2002 | Huang |
| 6,474,513 | B2 | 11/2002 | Burt |
| 6,478,198 | B2 | 11/2002 | Haroian |
| 6,478,561 | B2 | 11/2002 | Braun et al. |
| 6,482,392 | B1 | 11/2002 | Zhou et al. |
| D468,980 | S | 1/2003 | Woods |
| 6,510,969 | B2 | 1/2003 | Di Giovanni et al. |
| 6,520,377 | B2 | 2/2003 | Yquel |
| 6,531,528 | B1 | 3/2003 | Kurp |
| 6,536,633 | B2 | 3/2003 | Stern et al. |
| 6,581,807 | B1 | 6/2003 | Mekata |
| 6,588,628 | B2 | 7/2003 | Abplanalp et al. |
| 6,595,393 | B1 | 7/2003 | Loghman-Adham et al. |
| 6,613,186 | B2 | 9/2003 | Johnson |
| 6,615,827 | B2 | 9/2003 | Greenwood et al. |
| 6,637,627 | B1 | 10/2003 | Liljeqvist et al. |
| 6,641,005 | B1 | 11/2003 | Stern et al. |
| 6,641,864 | B2 | 11/2003 | Woods |
| 6,652,704 | B2 | 11/2003 | Green |
| 6,659,312 | B1 | 12/2003 | Stern et al. |
| 6,666,352 | B1 | 12/2003 | Woods |
| 6,688,492 | B2 | 2/2004 | Jaworski et al. |
| 6,712,238 | B1 | 3/2004 | Mills |
| 6,726,066 | B2 | 4/2004 | Woods |
| 6,736,288 | B1 | 5/2004 | Green |
| 7,374,068 | B2 | 5/2008 | Greer, Jr. |
| 7,487,893 | B1 | 2/2009 | Greer, Jr. et al. |
| 7,677,420 | B1 | 3/2010 | Greer, Jr. et al. |
| 7,784,649 | B2 | 8/2010 | Greer, Jr. |
| 7,947,753 | B2 | 5/2011 | Greer, Jr. |
| 8,042,713 | B2 | 10/2011 | Greer, Jr. et al. |
| 8,172,113 | B2 | 5/2012 | Greer, Jr. |
| 8,251,255 | B1 | 8/2012 | Greer, Jr. et al. |
| 8,313,011 | B2 | 11/2012 | Greer, Jr. et al. |
| 8,336,742 | B2 | 12/2012 | Greer, Jr. et al. |
| 8,420,705 | B2 | 4/2013 | Greer, Jr. |
| 8,561,840 | B2 | 10/2013 | Greer, Jr. et al. |
| 8,622,255 | B2 | 1/2014 | Greer, Jr. |
| 2002/0003147 | A1 | 1/2002 | Corba |
| 2002/0100769 | A1 | 8/2002 | McKune |
| 2003/0102328 | A1 | 6/2003 | Abplanalp et al. |
| 2003/0134973 | A1 | 7/2003 | Chen et al. |
| 2003/0183651 | A1 | 10/2003 | Greer, Jr. |
| 2003/0205580 | A1 | 11/2003 | Yahav |

FOREIGN PATENT DOCUMENTS

| | | |
|---|---|---|
| CA | 1191493 | 8/1985 |
| CA | 1210371 | 8/1986 |
| CA | 2145129 | 9/1995 |
| CA | 2090185 | 10/1998 |
| CA | 2224042 | 6/1999 |
| CA | 2291599 | 6/2000 |
| CA | 2381994 | 2/2001 |
| CA | 2327903 | 6/2001 |
| CA | 2065534 | 8/2003 |
| CA | 2448794 | 5/2004 |
| CH | 680849 | 11/1992 |
| DE | 210449 | 5/1909 |
| DE | 1926796 | 3/1970 |
| DE | 3808438 | 4/1989 |
| DE | 3806991 | 9/1989 |
| FR | 463476 | 2/1914 |
| FR | 84727 | 4/1964 |
| FR | 1586067 | 2/1970 |
| FR | 2659847 | 9/1991 |
| GB | 867713 | 5/1961 |
| GB | 970766 | 9/1964 |
| GB | 977860 | 12/1964 |
| GB | 1144385 | 5/1969 |
| JP | 461392 | 1/1971 |
| JP | 55142073 | 11/1980 |
| JP | 8332414 | 6/1995 |
| WO | 9418094 | 8/1994 |

OTHER PUBLICATIONS

Chadwick, "Controlling Particle Size in Self-Pressurized Aerosol Packages", Metal Finishing, Jul./Aug. 2004, vol. 102 No. 7/8.

Homax Products, Inc., "Easy Touch Spray Texture" brochure, Mar. 1992, 1 page.

Newman-Green, Inc., "Aerosol Valves, Sprayheads & Accessories Catalog", Apr. 1, 1992, pp. 14, 20, and 22.

Tait, "An Introduction to Electrochemical Corrosion Testing for Practicing Engineers and Scientists," 1994, 17 pages.

AEROSOL SPRAY TEXTURE APPARATUS FOR A PARTICULATE CONTAINING MATERIAL

RELATED APPLICATIONS

This application, U.S. patent application Ser. No. 14/059,277 filed Oct. 21,2013, is a continuation of U.S. patent application Ser. No. 13/597,181 filed Aug. 28, 2012, now U.S. Pat. No. 8,561,840 which issued Oct. 22, 2013.

U.S. patent application Ser. No. 13/597,181 is a continuation of U.S. patent application Ser. No. 12/725,417 filed Mar. 16, 2010, now U.S. Pat. No. 8,251,255, which issued on Aug. 28, 2012.

U.S. patent application Ser. No. 12/725,417 is a continuation of U.S. patent application Ser. No. 11/173,492 filed on Jun. 30, 2005, now U.S. Pat. No. 7,677,420, which issued on Mar. 16, 2010.

U.S. patent application Ser. No. 11/173,492 claims benefit of U.S. Provisional Application Ser. No. 60/585,233 filed Jul. 2, 2004.

The contents of all applications listed above are incorporated herein by reference.

TECHNICAL FIELD

The present invention relates to a texture spraying apparatus for discharging a texture material onto a surface, and more particularly to an aerosol spray texture apparatus particularly adapted to discharge a texture material having particulate matter contained therein.

BACKGROUND

Buildings are commonly comprised of a frame to which a roof, exterior walls, and interior walls and ceilings are attached. The interior walls and ceilings are commonly formed using sheets of drywall material that are attached to frame, usually by screws or nails. When the sheets of drywall are hung, small gaps are normally formed between adjacent sheets of drywall material. In addition, the fasteners are countersunk slightly but are visible.

To hide the gaps and fastener heads, tape and/or drywall compound are applied over the gaps and/or fastener heads. The drywall compound is sanded so that the interior surfaces (wall and ceiling) are smooth and continuous. The interior surfaces are then primed for further finishing.

After the priming step, a texture material is often applied to interior surfaces before painting. The texture material forms a bumpy, irregular surface that is aesthetically pleasing. The textured interior surface also helps to hide irregularities in the interior surface.

Some interior surfaces, especially ceilings, are covered with a special type of texture material referred to as acoustic texture material. Acoustic texture material contains particulate material that adheres to the interior surface. The purpose of the particulate material is partly aesthetic and partly functional. The particles absorb rather than reflect sound and thus can reduce echo in a room. The term "acoustic" texture material is used because of the sound absorptive property of this type of texture material.

When repairs are made to interior walls and ceilings, the texture material often must be reapplied. The newly applied texture material should match the original texture material.

A number of products are available that allow the application of texture material in small quantities for the purpose of matching existing texture material. In addition to hopper based dispensing systems, texture material may be applied in small quantities using aerosol systems. With conventional texture material that does not include particles, a variety of oil and water based texture materials in aerosol texturing systems are available.

Acoustic texture materials pose problems that have heretofore limited the acceptance of aerosol texturing systems. In particular, most acoustic texture materials contain polystyrene chips that dissolve in commercially available aerosol propellant materials. Thus, conventional aerosol propellant materials are not available for use with conventional acoustic texture materials.

The Applicants have sold since approximately 1995 a product that employs compressed inert gas, such as air or nitrogen, as the propellant. The compressed gas does not interact with the particles in the acoustic texture material. The compressed air resides in the upper portion of the aerosol container and forces the acoustic texture material out of the container through a dip tube that extends to the bottom of the container.

While commercially viable, the use of compressed inert gas to dispense acoustic texture material from an aerosol container assembly presents several problems. First, if the aerosol system is operated while inverted, the compressed inert gas escapes and the system becomes inoperative. Second, the compressed inert gas can force all of the acoustic texture material out of the aerosol container in a matter of seconds. An inexperienced user can thus inadvertently and ineffectively empty the entire container of acoustic texture material.

The Applicants are also aware of an aerosol product that sprays a foam material instead of a true acoustic texture material. The foam material does not contain particulate material, and thus the resulting texture formed does not accurately match an existing coat of true acoustic texture material.

The need thus exists for a system for dispensing acoustic texture material that provides the convenience of an aerosol texturing system, employs true acoustic texture material, and is easily used by inexperienced users.

RELATED ART

There are in the prior art various devices to spray a texture material onto a wall surface or a ceiling. Depending upon the composition of the texture material, and other factors, the material that is sprayed onto the surface as a coating can have varying degrees of "roughness".

In some instances, the somewhat roughened texture is achieved by utilizing a textured composition that forms into droplets when it is dispensed, with the material then hardening with these droplets providing the textured surface. In other instances, solid particulate material is mixed with the liquid texture material so that with the particulate material being deposited with the hardenable liquid material on the wall surface, these particles provide the textured surface. However, such prior art aerosol spray texture devices have not been properly adapted to deliver a texture having particulate matter therein to provide the rougher texture.

In particular, the Applicants are aware of prior art spray texture devices using an aerosol container which contains the texture material mixed with a propellant under pressure and from which the textured material is discharged onto a surface. Such aerosol dispensers are commonly used when there is a relatively small surface area to be covered with the spray texture material. Two such spray texture devices are disclosed in U.S. Pat. No. 5,037,011, issued Aug. 6, 1991, and more recently U.S. Pat. No. 5,188,263, issued Feb. 23, 1993 with John R. Woods being named inventor of both of these patents.

Additionally, the Assignee of the present invention has since approximately 1983 manufactured and sold manually operated devices for applying spray texture material onto walls and ceilings. These spray texture devices are described in one or more of the following U.S. Pat. Nos. 4,411,387; 4,955,545; 5,069,390; 5,188,295.

Basically, these spray texture devices comprised a hopper containing hardenable material, a manually operated pump, and a nozzle. By pointing the device at the area being patched and operating the manual pump, the hardenable material and pressurized air generated by the pump were mixed in the nozzle and subsequently sprayed onto the area being patched.

When applied to a ceiling, the hardenable material employed by these prior art spray texture devices basically comprised a mixture of the following ingredients: water to form a base substance and a carrier for the remaining ingredients; a filler substance comprising clay, mica, and/or calcium carbonate; an adhesive binder comprising natural and/or synthetic polymers; and an aggregate comprising polystyrene particles.

The filler, adhesive binder, and aggregate are commercially available from a variety of sources. The hardenable material employed by these prior art spray texture devices further comprised one or more of the following additional ingredients, depending upon the circumstances: thickeners, surfactants, defoamers, antimicrobial materials, and pigments.

SUMMARY

The present invention may be embodied as a method of applying texture material to a surface comprising the following steps. A propellant material comprising di-methyl ether is provided. Discrete chips, each have a physical structure, are provided. The physical structures of the chips are not substantially altered when the chips are exposed to the propellant material. The chips are combined with a coating portion to obtain acoustic texture material. A container assembly defining a product chamber is provided. The acoustic texture material is arranged within the product chamber. The propellant material is arranged within the product chamber such that a liquid phase portion of the propellant material is mixed with the acoustic texture material and a gas phase portion of the propellant material pressurizes the acoustic texture material within the product chamber. The propellant material is allowed to force the acoustic texture material from the product chamber and onto the surface.

The present invention may also be embodied as a texturing system for applying acoustic texture material to a surface. The texturing system comprises propellant material, acoustic texture material, and a container. The propellant material comprises di-methyl ether. The acoustic texture material comprises a coating portion and chips of chip material having a physical structure, where the physical structure of the chip material is not substantially altered when the chips are exposed to the propellant material. The container assembly defines a product chamber, where the propellant material and the acoustic texture material are disposed within the product chamber. A liquid phase portion of the propellant material is mixed with the acoustic texture material and a gas phase portion of the propellant material pressurizes the acoustic texture material within the product chamber. The propellant material forces the acoustic texture material from the product chamber and onto the surface.

The present invention may also be embodied as a composition for forming an acoustic texture material on a surface. The composition of the present invention comprises a propellant material and acoustic texture material. The propellant material comprises di-methyl ether. The acoustic texture material comprises a coating portion comprising a base, a filler, and a binder and chips of chip material having a physical structure. When the propellant material and the acoustic texture material are mixed together, the propellant material does not substantially alter the physical structure of the chip material.

DESCRIPTION OF EMBODIMENTS

Figure 1:
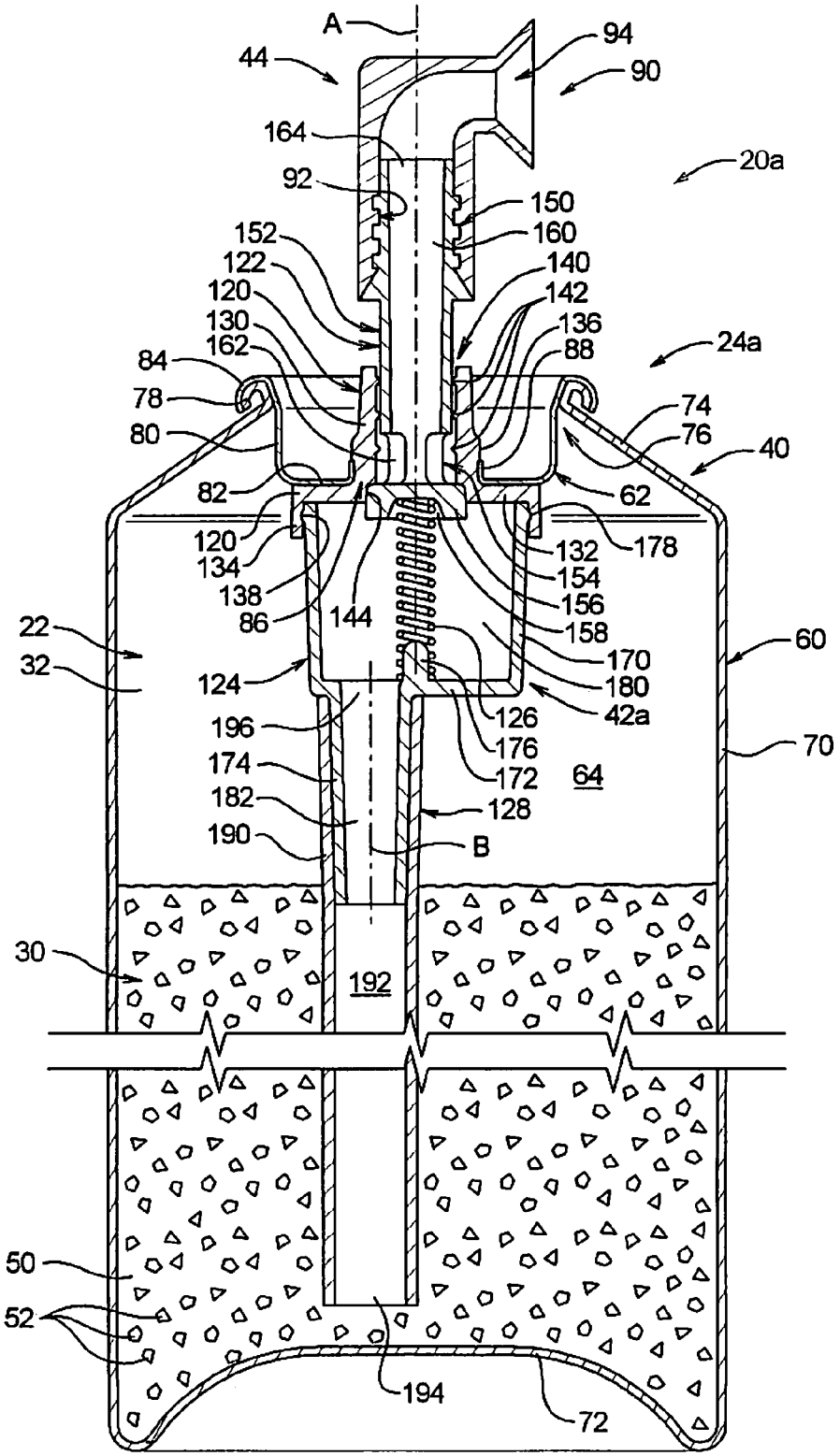
FIG. 1 is a cut-away, side elevation view of a first exemplary mechanical system of the present invention.
Figure 2:
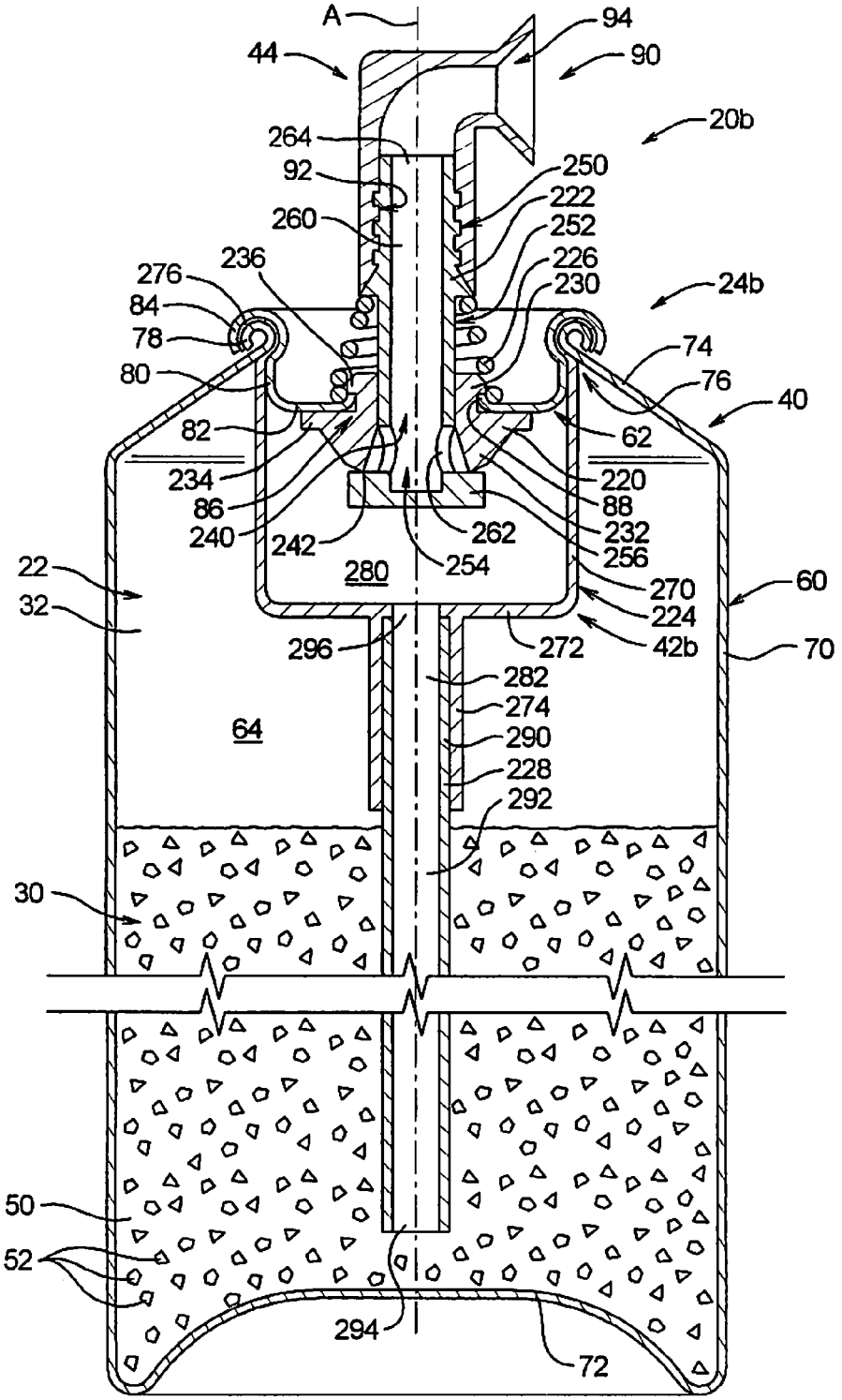
FIG. 2 is a cut-away, side elevation view of a second exemplary mechanical system of the present invention.

Depicted in FIGS. 1 and 2 of the drawing are first and second examples of an aerosol acoustic texturing systems 20*a* and 20*b* constructed in accordance with, and embodying, the principles of the present invention. In the following discussion and the drawing, the appendices "a" and "b" will be used to refer to features unique to the first and second example texturing systems 20*a* and 20*b*, respectively.

The example aerosol acoustic texturing systems 20*a* and 20*b* comprise a fluid system 22 and a mechanical system 24*a*, 24*b*. The fluid system 22 comprises an acoustic texture material 30 to be dispensed and a propellant material 32. The mechanical systems 24*a* and 24*b* comprise a container assembly 40, an actuator 44, and a valve assembly 42*a* and 42*b*, respectively. For clarity in FIGS. 1 and 2, the texture material 30 is shown only in the container assembly 40; as will be described in further detail below, the texture material will also be forced into the valve assembly 42*a*, 42*b* and, in some situations, through and out the actuator 44.

The container assemblies 40 and actuator 44 of the example mechanical systems 24*a* and 24*b* are or may be the substantially the same and will be described only once below. The valve assemblies 42*a* and 42*b* differ and will each be described separately below.

In use, the acoustic texture material 30 and propellant material 32 are stored within the container assembly 40. The propellant material 32 pressurizes the acoustic texture material 30. The valve assembly 42*a*, 42*b* is normally in a closed state, and depressing the actuator 44 causes the valve assembly 42*a*, 42*b* to be placed into an open state. When the valve assembly 42*a*, 42*b* is in the open state, the pressurized propellant material 32 forces the acoustic texture material 30 out of the container assembly 40 and onto a target surface to be coated.

The example acoustic texture material 30 comprises a coating portion 50 and a particulate portion 52. The coating portion 50 exists in a liquid state when stored in the air-tight container assembly 40 but hardens when exposed to the air. The coating portion 50 is not per se important to any particular implementation of the present invention. The particulate portion 52 is formed by small chips or particles of irregular shape but relatively consistent volume. The example particulate portion 52 is formed by chips made of one or more of compressible foam materials, such as urethane, that is compatible with certain aerosol propellants as will be described below.

The example particulate portion 52 is formed by urethane chips. The urethane material forming the particulate portion 52 is typically manufactured in blocks. These blocks must be chopped or otherwise processed to obtain the chips described above.

As mentioned above, the propellant material 32 must be compatible with the material or materials forming the particulate portion 52 of the texture material 30. As used herein, the term "compatible" refers to the lack of chemical or biological interaction between the propellant material 32 and the particulate portion 52 that would substantially permanently alter the physical structure or appearance of the chips forming the particulate portion 52. The example particulate portion 52 as described above allows the propellant material 32 to be formed by conventional aerosol propellant materials that would dissolve polystyrene chips used in conventional texture materials.

As examples, one or more of the following materials may be used to form the example propellant material 32: di-methyl ethylene (DME); compressed air; and compressed nitrogen. The propellant material 32 used by the example aerosol system 20 is formed by DME. When DME is used as the propellant material 32, the propellant material 32 exists partly in a liquid phase that is mixed with the acoustic texture material 30 and partly in a gas phase that pressurizes the acoustic texture material 30.

As the acoustic texture material 30 is forced out of the container assembly 40, the pressure within the container assembly 40 drops. This pressure drop causes more of the liquid phase propellant material 32 to gasify. Once the actuator 44 is released and the valve assembly 42 returns to its closed state, the gas phase propellant material 32 continues to gasify until the acoustic texture material 30 within the container assembly 40 is again pressurized. The use of DME as the propellant material 32 pressurizes the texture material 30 at a relatively constant, relatively low level that allows the controlled dispensing of the texture material 30.

Inert, compressed gasses, such as air or nitrogen, may be used as the propellant material 32. A propellant 32 formed of compressed inert gasses pressurizes the container to force the texture material 30 out of the container assembly 40. To accommodate expansion of the compressed inert gasses, the system 20 is typically charged to a relatively high initial pressure.

With any of the propellants listed above, the chips forming the particulate portion 52 of the texture material 30 may be compressed when stored in the container assembly under pressure. The chips forming the particulate portion 52 stay in this compressed configuration until they flow out of the container assembly 40 and are no longer under pressure. In this compressed configuration, the particulate portion 52 is less likely to clog any dispensing passageways formed by the valve assembly 42 and/or actuator 44. The propellant material 32 thus may temporarily change the volume of the chips forming the particulate portion 52, but should not permanently deform or dissolve these chips when stored in the container assembly 40.

Given the foregoing basic understanding of the example aerosol acoustic texturing systems 20*a* and 20*b*, the details of the systems 20*a* and 20*b* will now be described below in further detail.

I. Coating Portion

The coating portion 50 of the texture material 30 forming part of the fluid system 22 may be conventional and typically includes the following components: water as a base and carrier; a filler material (e.g., calcium carbonate, mica, and/or clay); and natural and/or synthetic binder. In addition, the hardenable material may also comprise one or more of the following ingredients: a pigment compound such as a whitener; a thickener for controlling the film integrity of the composition; a defoamer to facilitate processing and minimize bubbles when spraying; a surfactant; a preservative; a dispersant; and an antimicrobial component.

II. Container Assembly And Actuator

Referring now to FIGS. 1 and 2, the container assembly 40 and actuator 44 of the example mechanical systems 24*a* and 24*b* will now be described in detail. The example container assemblies 40 each comprises a container 60 and a cap 62. The cap 62 is attached to the container 60 to define a main chamber 64.

The container 60 is a metal body that comprises a side wall 70, lower wall 72, and upper wall 74. The upper wall 74 defines a cap opening 76 and an inner lip 78. The inner lip 78 extends around the cap opening 76. The cap 62 is also a metal body that comprises an extension wall 80, a base wall 82, and an outer lip 84. The base wall 82 defines a mounting opening 86 and a mounting wall 88. The mounting wall 88 extends around the mounting opening 86.

To form the container assembly 40, the outer lip 84 of the cap 62 is arranged over the inner lip 78 of the container 60. The outer lip 84 is crimped such that the outer lip 84 engages, directly or indirectly, the inner lip 78. The resulting container assembly 40 defines a relatively rigid structure. In addition, the outer lip 84 and inner lip 78 engage each other, directly or indirectly, to form a substantially fluid-tight seal; once the container assembly 40 is formed, fluid may flow into and out of the main chamber 64 only through the mounting opening 86. In the example system 20*a*, the outer lip 84 directly engages the inner lip 78. As will be described in further detail below, the outer lip 84 indirectly engages the inner lip 78 in the example system 20*b*.

The container assembly 40 as described is relatively conventional, and container assemblies of different construction may be used in place of the example container assembly 40 depicted in FIGS. 1 and 2.

The example actuator 44 is a plastic body defining an actuator passageway 90. The actuator passageway 90 comprises a threaded portion 92 and an outlet portion 94. As will be described in further detail below, the threaded portion 92 is adapted to engage the valve assemblies 42*a* and 42*b*. The example outlet portion 94 is frustoconical, but other shapes may be used instead or in addition. The example actuator passageway 90 turns along an angle of approximately 90 degrees, but the actuator passageway 90 may be straight turn along an angle other than 90 degrees.

The actuator 44 as described is also relatively conventional, and actuators of different construction may be used in place of the example actuator 44 depicted in FIGS. 1 and 2.

III. First Example Valve Assembly

Referring now specifically to FIG. 1, the first example valve assembly 42*a* will now be described in further detail. The valve assembly 42*a* comprises a valve seat 120, a valve stem 122, a valve housing 124, a valve spring 126, and a collection tube 128.

The example valve seat 120 comprises a support portion 130, a seat portion 132, and a wall portion 134. Extending from the support portion 130 is a retaining projection 136, and formed in the wall portion 134 is a retaining recess 138. In addition, the valve seat 120 defines a stem opening 140 that extends from the seat portion 132 and through the support portion 130. Extending from the support portion 130 into the stem opening 140 are a plurality of support projections 142. A seat surface 144 is formed in the seat portion 132 around the stem opening 140.

The valve stem 122 comprises a threaded portion 150, a guide portion 152, an inlet portion 154, and a stop portion 156. A spring cavity 158 is formed in the stop portion 156. The valve stem 122 further comprises a stem passageway 160 defining a stem inlet 162 and a stem outlet 164. The stem inlet 162 is formed in the inlet portion 154 of the valve stem 122, and the stem outlet 164 is formed adjacent to the threaded portion 150 of the stem 122.

The valve housing 124 comprises a side wall 170, a bottom wall 172, a tube projection 174, and a spring projection 176. A mounting projection 178 extends from the side wall 170. The valve housing 124 defines a valve chamber 180, and a housing inlet passageway 182 extends through the tube projection 174 to allow fluid to flow into the valve chamber 180.

The housing inlet passageway 182 defines a housing inlet axis B. In the example valve assembly 42, the housing inlet axis B is parallel to and offset from the valve axis A. Other configurations may be used, but offsetting the housing inlet axis B from the valve axis A allows the spring projection 176 to be aligned with the valve axis A. The spring 126 itself thus may be aligned with the valve axis A.

The collection tube 128 comprises a side wall 190 and defines a tube passageway 192. The tube passageway 192 defines a tube inlet 194 and a tube outlet 196.

The valve assembly 42*a* is formed generally as follows. The following assembly steps may be performed in different sequences, and the following discussion does not indicate a preferred or necessary sequence of assembly steps.

The valve stem 122 is arranged such that the guide portion 152 thereof is received within the stem opening 140. The geometry of the example valve stem 122 requires a two-piece construction that would allow the relatively wide threaded portion 150 to be attached to the relatively wide stop portion 156 after the guide portion 152 has been arranged within the stem opening 140. If the threaded portion 150 is relatively narrow and can be inserted through the stem opening 140, the valve stem 122 may be made of a single-piece construction. As another alternative, the threaded portion 150 may be eliminated; in this case, the actuator 44 is secured to the valve stem 122 by other means such as friction and/or the use of an adhesive.

The valve spring 126 is arranged such that one end thereof is retained by the spring projection 176 on the bottom wall 172 of the valve housing 124. The valve housing 124 is displaced until the mounting projection 178 on the housing side wall 170 is received by the retaining recess 138 on the wall portion 134 of the valve seat 120. The other end of the spring 126 is received by the spring cavity 158 in the valve seat 120.

The support projections 142 on the support portion 130 of the valve seat 120 engage the guide portion 152 of the valve stem 122 to restrict movement of the valve stem 122 within a predetermined range along a valve axis A. The valve spring 126 resiliently opposes movement of the valve stem 122 towards the bottom wall 172 of the valve housing 124.

The valve seat 120 is displaced such that the support portion 130 extends through the mounting opening 86 in the cap 62. Further displacement of the valve seat 120 forces the retaining projection 136 on the valve seat 120 past the mounting wall 88 on the cap 62. The retaining projection 136 engages the mounting wall 88 to mechanically attach the valve seat 120 onto the cap 62. The overlap of the mounting wall 88 and base wall 82 with the valve seat 120 forms a substantially fluid-tight seal around the mounting opening 86.

The collection tube 128 is secured to the valve housing 124 by inserting the tube 128 into the housing inlet passageway 182 or, as shown in FIG. 1, inserting the tube projection 174 into the tube passageway 192.

The actuator 44 is attached to the valve stem 122. In particular, in the example mechanical system 24*a*, the threaded portions 92 and 150 engage each other to detachably attach the actuator 44 to the valve stem 122. As generally discussed above, other attachment systems may be used to attach the actuator 44 to the valve stem 122.

The valve assembly 42*a* operates basically as follows. The valve spring 126 biases the valve stem 122 into an extended position as shown in FIG. 1. When the valve stem 122 is in the extended position, the stop portion 156 thereof engages the seat surface 144 formed on the valve seat 120. The example seat surface 144 is annular and curved. The stop portion 156 is sized and configured to conform to the shape of the seat surface 144.

Accordingly, when the stop portion 156 of the valve stem engages the seat surface 144, fluid flow between the valve chamber 180 and the stem passageway 160 is substantially prevented, and the valve assembly 42*a* is in its closed position. However, by applying a force on the actuator 44 sufficient to compress the valve spring 126, the stop portion 156 is displaced away from the seat surface 144 to place the valve assembly 42*a* into its open configuration. When the valve assembly 42*a* is in its open configuration, fluid may flow between the valve chamber 180 and the stem passageway 160.

When fitted with the first example valve assembly 42*a*, the aerosol acoustic texturing system 20*a* is used to dispense texture material 30 as follows. The actuator 44 is aimed towards a target surface and depressed towards the cap member 62 to place the valve assembly 42*a* in its open configuration. The propellant material 32 forces the texture material 30 through the tube inlet 194, the tube passageway 192, the tube outlet 196, and the housing inlet 182 and into the valve chamber 180.

From the valve chamber 180, the texture material 30 flows between the stop portion 156 and the seat surface 144 and into the stem inlet 162. The texture material 30 then flows through the stem passageway 160 and out of the stem outlet 164. The texture material 30 then flows along the actuator passageway 90 and out of the outlet portion 94 thereof. The texture material 30 discharged through the outlet portion 94 forms a spray and ultimately lands on the target surface.

When sufficient texture material 30 has been deposited onto the target surface, the force on the actuator 44 is released. The valve spring 126 displaces the valve stem 122 to place the valve assembly 42*a* back into its closed configuration. The texture material 30 thus no longer flows out of the housing chamber 180 through the stem passageway 160.

IV. Second Example Valve Assembly

Referring now specifically to FIG. 2, the second example valve assembly 42*b* will now be described in further detail. The valve assembly 42*b* comprises a valve seat 220, a valve stem 222, a valve housing 224, a valve spring 226, and a collection tube 228.

The example valve seat 220 comprises a support portion 230, a seat portion 232, and a wall portion 234. Extending from the support portion 230 is a retaining projection 236. In addition, the valve seat 220 defines a stem opening 240 that extends from the seat portion 232 and through the support portion 230. A seat edge 242 is formed in the seat portion 232 around the stem opening 240.

The valve stem 222 comprises a threaded portion 250, a guide portion 252, an inlet portion 254, and a stop portion 256. The valve stem 222 further comprises a stem passageway 260 defining a stem inlet 262 and a stem outlet 264. The stem inlet 262 is formed in the inlet portion 254 of the valve stem 222, and the stem outlet 264 is formed adjacent to the threaded portion 250 of the stem 222.

The valve housing 224 comprises a side wall 270, a bottom wall 272, and a tube projection 274. A mounting portion 276 extends from the side wall 270. The valve housing 224 defines a valve chamber 280, and a housing inlet passageway 282 extends through the tube projection 274 to allow fluid to flow into the valve chamber 280.

The collection tube 228 comprises a side wall 290 and defines a tube passageway 292. The tube passageway 292 defines a tube inlet 294 and a tube outlet 296.

The valve assembly 42*b* is formed generally as follows. The following assembly steps may be performed in different sequences, and the following discussion does not indicate a preferred or necessary sequence of assembly steps.

The valve stem 222 is arranged such that the guide portion 252 thereof is received within the stem opening 240. The geometry of the example valve stem 222 requires a two-piece construction that would allow the relatively wide threaded portion 250 to be attached to the relatively wide stop portion 256 after the guide portion 252 has been arranged within the stem opening 240. If the threaded portion 250 is relatively narrow and can be inserted through the stem opening 240, the valve stem 222 may be made of a single-piece construction. As another alternative, the threaded portion 250 may be eliminated; in this case, the actuator 44 is secured to the valve stem 222 by other means such as friction and/or the use of an adhesive.

The valve spring 226 is arranged such that one end thereof is supported by the base wall 82 of the cap 62. The other end of the spring 226 is arranged below the actuator 44 such that depressing the actuator 44 towards the container assembly 40 compresses the spring 226.

The support portion 230 of the valve seat 220 engages the guide portion 252 of the valve stem 222 to restrict movement of the valve stem 222 within a predetermined range along a valve axis A. The valve spring 226 resiliently opposes movement of the valve stem 222 towards the bottom wall 272 of the valve housing 224.

The valve seat 220 is displaced such that the support portion 230 extends through the mounting opening 86 in the cap 62. Further displacement of the valve seat 220 forces the retaining projection 236 on the valve seat 220 past the mounting wall 88 on the cap 62. The retaining projection 236 engages the mounting wall 88 to mechanically attach the valve seat 220 onto the cap 62. The overlap of the mounting wall 88 and base wall 82 with the valve seat 220 forms a substantially fluid-tight seal around the mounting opening 86.

The collection tube 228 is secured to the valve housing 224 by inserting the tube projection 274 into the tube passageway 292 or, as shown in FIG. 2, inserting the collection tube 228 at least partly into the housing inlet passageway 282.

The actuator 44 is attached to the valve stem 222. In particular, in the example mechanical system 24*b*, the threaded portions 92 and 250 engage each other to detachably attach the actuator 44 to the valve stem 222. As generally discussed above, other attachment systems may be used to attach the actuator 44 to the valve stem 222.

The valve assembly 42*b* operates basically as follows. The valve spring 226 biases the valve stem 222 into an extended position as shown in FIG. 2. When the valve stem 222 is in the extended position, the stop portion 256 thereof engages the seat edge 242 formed on the valve seat 220. When the stop portion 256 of the valve stem engages the seat edge 242, fluid flow between the valve chamber 280 and the stem passageway 260 is substantially prevented, and the valve assembly 42*b* is in its closed position.

However, by applying a force on the actuator 44 sufficient to compress the valve spring 226, the stop portion 256 is displaced away from the seat edge 242 to place the valve assembly 42*b* into its open configuration. When the valve assembly 42*b* is in its open configuration, fluid may flow between the valve chamber 280 and the stem passageway 260.

When fitted with the first example valve assembly 42*b*, the aerosol acoustic texturing system 20*b* is used to dispense texture material 30 as follows. The actuator 44 is aimed towards a target surface and depressed towards the cap member 62 to place the valve assembly 42*b* in its open configuration. The propellant material 32 forces the texture material 30 through the tube inlet 294, the tube passageway 292, the tube outlet 296, and the housing inlet 282 and into the valve chamber 280.

From the valve chamber 280, the texture material 30 flows between the stop portion 256 and the seat edge 242 and into the stem inlet 262. The texture material 30 then flows through the stem passageway 260 and out of the stem outlet 264. The texture material 30 then flows along the actuator passageway 90 and out of the outlet portion 94 thereof. The texture material 30 discharged through the outlet portion 94 forms a spray and ultimately lands on the target surface.

When sufficient texture material 30 has been deposited onto the target surface, the force on the actuator 44 is released. The valve spring 226 displaces the valve stem 222 to place the valve assembly 42*b* back into its closed configuration. The texture material 30 thus no longer flows out of the valve chamber 280 through the stem passageway 260.

What is claimed is:

1. A method of applying texture material to a surface, comprising:

providing a propellant material comprising di-methyl ether;

providing discrete chips, where the discrete chips of each have a physical structure; and the physical structures of the chips are not substantially altered when the chips are exposed to the propellant material;

combining the chips with a coating portion to obtain acoustic texture material;

providing a container assembly defining a product chamber;

arranging the acoustic texture material within the product chamber;

arranging propellant material within the product chamber such that a liquid phase portion of the propellant material is mixed with the acoustic texture material and a gas phase portion of the propellant material pressurizes the acoustic texture material within the product chamber; and allowing the propellant material to force the acoustic texture material from the product chamber and onto the surface.

2. A method as recited in claim 1, in which the chips are made of urethane.

3. A method as recited in claim 1, in which the coating portion of the acoustic texture material comprises a base, a filler, and a binder.

4. A method as recited in claim 3, in which the coating portion of the acoustic texture material further comprises at least one of a pigment, a thickener, a defoamer, a surfactant, a dispersant, and an antimicrobial component.

5. A texturing system for applying acoustic texture material to a surface, comprising:

a propellant material comprising di-methyl ether;

acoustic texture material comprising a coating portion, and chips of chip material having a physical structure, where the physical structure of the chip material is not substantially altered when the chips are exposed to the propellant material; and a container assembly defining a product chamber, where the propellant material and the acoustic texture material are disposed within the product chamber; wherein a liquid phase portion of the propellant material is mixed with the acoustic texture material and a gas phase portion of the propellant material pressurizes the acoustic texture material within the product chamber; and the propellant material forces the acoustic texture material from the product chamber and onto the surface.

6. A texturing system as recited in claim 5, in which the coating portion of the acoustic texture material comprises a base, a filler, and a binder.

7. A texturing system as recited in claim 6, in which the coating portion of the acoustic texture material further comprises at least one of a pigment, a thickener, a defoamer, a surfactant, a dispersant, and an antimicrobial component.

* * * * *